US012729605B1

(12) United States Patent
Al-Mousa et al.

(10) Patent No.: US 12,729,605 B1
(45) Date of Patent: Sep. 8, 2026

(54) DEVICE AND USE THEREOF WITHIN AN INTERVAL CONTROL VALVE

(71) Applicant: SAUDI ARABIAN OIL COMPANY, Dhahran (SA)

(72) Inventors: Ahmed Al-Mousa, Dhahran (SA); Linlin Wang, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 19/313,251

(22) Filed: Aug. 28, 2025

(51) Int. Cl.
*E21B 41/00* (2006.01)
*E21B 7/06* (2006.01)

(52) U.S. Cl.
CPC ..... *E21B 41/0035* (2013.01); *E21B 7/061* (2013.01)

(58) Field of Classification Search
CPC ..... E21B 7/061; E21B 41/0035
See application file for complete search history.

(56) References Cited

U.S. PATENT DOCUMENTS

| | | | |
|---|---|---|---|
| 8,919,439 | B2 | 12/2014 | Grigsby et al. |
| 11,359,457 | B2 | 6/2022 | Kent et al. |
| 2020/0032620 | A1 | 1/2020 | Steele et al. |

FOREIGN PATENT DOCUMENTS

WO WO-2025042385 A1 * 2/2025 ..... E21B 41/0035

* cited by examiner

*Primary Examiner* — Tara Schimpf
*Assistant Examiner* — Lamia Quaim
(74) *Attorney, Agent, or Firm* — Osha Bergman Watanabe & Burton LLP

(57) ABSTRACT

A device includes an outer sleeve, inner sleeve, deflector, and first and second control lines. The outer sleeve has an outer chamber and an outer opening extending from the outer chamber to an outer surface. The inner sleeve is disposed within the outer chamber. The inner sleeve has an inner chamber and an inner opening extending from the inner chamber to an outer surface. The inner opening is alignable with the outer opening by a first rotation of the inner sleeve. The inner opening is misalignable with the outer opening by a second rotation of the inner sleeve. The deflector is disposed within the inner chamber. The first control line controls an open position of the device by controlling the first rotation and a closed position of the device by controlling the second rotation. The second control line controls open and closed positions of the deflector.

15 Claims, 9 Drawing Sheets

DEVICE AND USE THEREOF WITHIN AN INTERVAL CONTROL VALVE

BACKGROUND

Sidetrack wells or laterals that branch off from a main well drilled within a formation often require completion or workover operations, such as stimulation and logging operations. To perform such operations, bottom hole assemblies may need to be disposed within the main well and sidetrack well using a conveyance mechanism, such as coiled tubing, wireline, drillpipe, or slickline.

However, previously installed tubing systems and traditional interval control valves disposed within the main well and near the opening of the sidetrack well may not allow the conveyance mechanism and bottom hole assembly to pass through them to reach the sidetrack well such that the operation may be performed.

Because of this limitation, several runs to dispose equipment downhole and retrieve equipment to the surface are performed such that the sidetrack well can be accessed and the operation performed. For example, several runs may be performed to retrieve a previously installed isolation sleeve to the surface, install a lateral deflector downhole, dispose the bottom hole assembly downhole, retrieve the bottom hole assembly and lateral deflector to the surface, and reinstall the isolation sleeve back downhole.

Accordingly, there is a need to develop devices, systems, and methods to reduce the number of runs needed to access a sidetrack well such that the operation may be performed on the sidetrack well.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In general, in one aspect, embodiments relate to a device. The device includes an outer sleeve, an inner sleeve, a deflector, a first control line, and a second control line. The outer sleeve extends along an axis and has an outer chamber and an outer opening. The outer opening extends from the outer chamber to an outer surface of the outer sleeve. The inner sleeve is disposed within the outer chamber. The inner sleeve has an inner chamber and an inner opening extending from the inner chamber to an outer surface of the inner sleeve. The inner opening is alignable with the outer opening by a first rotation of the inner sleeve relative to the outer sleeve and around the axis. The inner opening is misalignable with the outer opening by a second rotation of the inner sleeve relative to the outer sleeve and around the axis. The deflector is disposed within the inner chamber and adjacent to the inner opening. The first control line is coupled to the inner sleeve and controls an open position of the device by controlling the first rotation and a closed position of the device by controlling the second rotation. The second control line is coupled to the deflector and controls an open position and a closed position of the deflector.

In general, in another aspect, embodiments relate to a system. The system includes a tubing system and a device. The tubing system is disposed within an interval along a well within a formation and configured to control an amount of fluid. The device is disposed along the tubing system. The device includes an outer sleeve, an inner sleeve, a deflector, a first control line, and a second control line. The outer sleeve extends along an axis and has an outer chamber and an outer opening. The outer opening extends from the outer chamber to an outer surface of the outer sleeve. The inner sleeve is disposed within the outer chamber. The inner sleeve has an inner chamber and an inner opening extending from the inner chamber to an outer surface of the inner sleeve. The inner opening aligns with the outer opening by a first rotation of the inner sleeve relative to the outer sleeve and around the axis. The inner opening misaligns with the outer opening by a second rotation of the inner sleeve relative to the outer sleeve and around the axis. The deflector is disposed within the inner chamber and adjacent to the inner opening. The first control line is coupled to the inner sleeve and configured to control an open position of the device by controlling the first rotation and a closed position of the device by controlling the second rotation. The second control line is coupled to the deflector and configured to control an open position and a closed position of the deflector.

In general, in yet another aspect, embodiments relate to a method. The method includes disposing a tubing system and a device within an interval along a well within a formation and opening the device by aligning the outer opening and the inner opening by rotating, using the first control line, the inner sleeve relative to the outer sleeve and around the axis by a first rotation. The method further includes closing, using the second control line, the deflector and guiding, using the deflector, a conveyance mechanism through the inner chamber, the inner opening, the outer opening, and the opening of the sidetrack well.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

Figure 1:
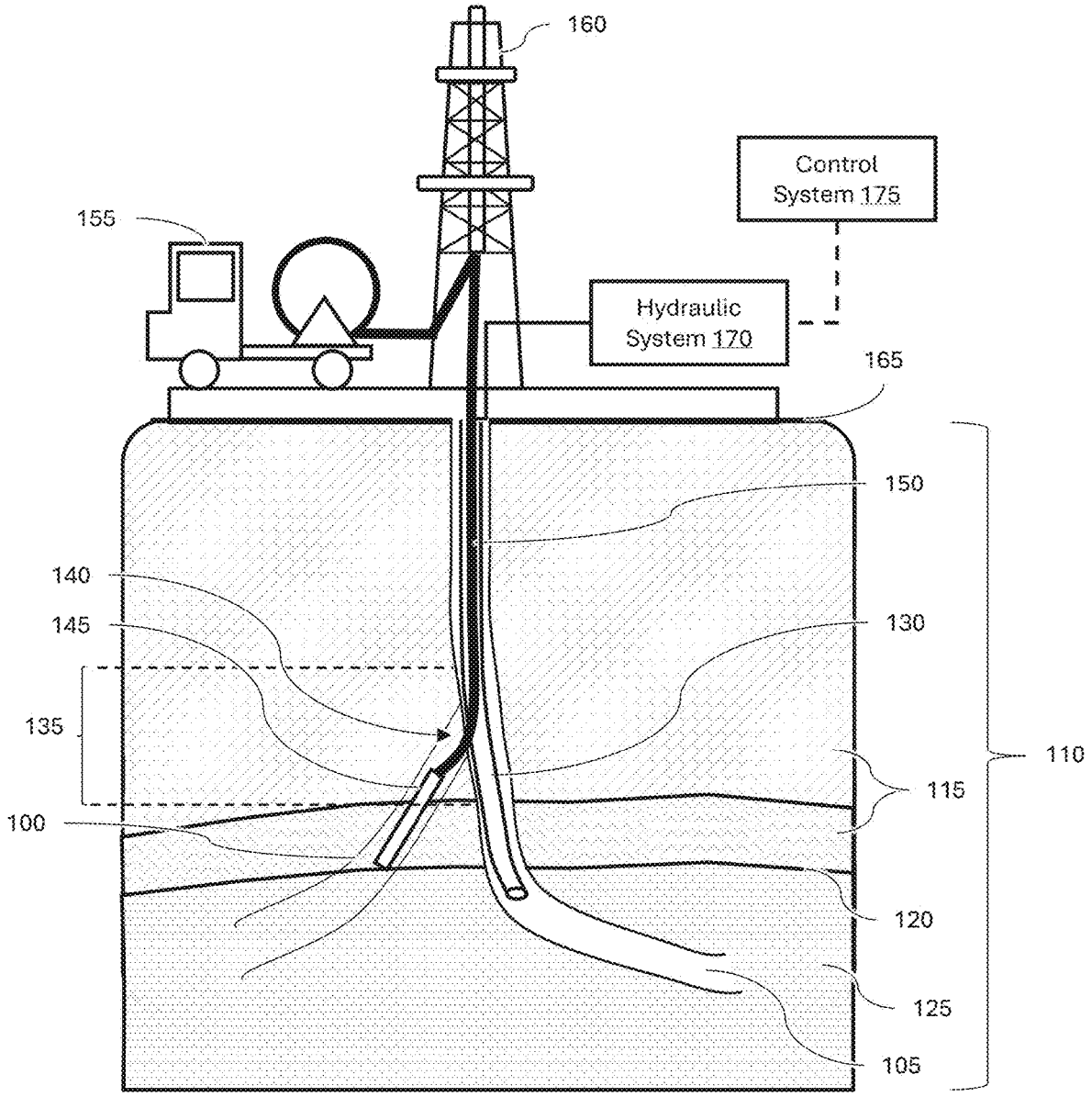
FIG. 1 illustrates an operation in accordance with one or more embodiments.

In the following detailed description of embodiments of the disclosure, numerous specific details are set forth to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before," "after," "single," and other such terminology. Rather, the use of ordinal numbers is to distinguish between the elements. By way of an example, a first element is distinct from a second element, and the first element may encompass more than one element and succeed (or precede) the second element in an ordering of elements.

It is to be understood that the singular forms "a," "an," and "the" include plural referents unless the context clearly dictates otherwise. Thus, for example, reference to "a deflector" includes reference to one or more of such deflectors.

Terms such as "approximately," "substantially," etc., mean that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

It is to be understood that one or more of the steps shown in the flowchart may be omitted, repeated, and/or performed in a different order than the order shown. Accordingly, the scope disclosed herein should not be considered limited to the specific arrangement of steps shown in the flowchart.

Devices, systems, and methods are disclosed herein. The device may be used within an interval control valve. The interval control valve is configured to perform one or more functions. One function of the interval control valve is to control the amount of production flowing from a reservoir into a well at an interval of the well that the interval control valve is disposed at. A second function of the interval control valve is to control the amount of injection fluid being injected into the reservoir through the well at the interval. Hereinafter, production and/or injection fluid are generally referred to as "fluid."

Accordingly, closure of the interval control valve may cause little-to-no fluid to pass through the interval control valve from or into the reservoir. The device may be disposed around the interval control valve. The device is configured to control (i.e., to allow or deny) access to a sidetrack well or lateral that branches off a main well drilled within a formation. Hereinafter, the terms "sidetrack well" and "lateral" are considered synonymous and used interchangeably. Accordingly, a single reference character is associated to both terms.

A traditional tubing system (e.g., a smart completion tubing system) that includes an isolation sleeve and an interval control valve among other parts does not allow access to sidetrack wells along or below the traditional tubing system when the traditional tubing system is installed within the main well. Accordingly, access to these sidetrack wells and the ability to perform an operation or intervention on these sidetrack wells can only be done by performing several runs to retrieve or deinstall the traditional tubing system or portion thereof uphole, install a lateral deflector (e.g., whipstock or flapper) downhole, dispose a bottom hole assembly via a conveyance mechanism downhole guided by the lateral deflector to perform the operation, retrieve the bottom hole assembly and lateral deflector uphole, and reinstall the traditional tubing system downhole. This process thus has several limitations in that it is labor intensive, expensive, time consuming, removes safety devices previously put in place by the tubing system in case of a kick, blowout, or other emergency, opens the crew up to injuries, possibly result in loss incidents, and may interrupt other operations.

The disclosed devices advantageously mitigate many of these limitations by allowing a sidetrack well to be accessed when an operation on the sidetrack well needs to be performed while the tubing system remains installed downhole. Accordingly, no runs to deinstall and reinstall the tubing system are needed. Further, the disclosed devices may include a deflector such that no runs to install and retrieve the deflector are needed. As such, only runs to dispose and retrieve the bottom hole assembly configured to perform the operation on the sidetrack well may be needed. The disclosed devices thus reduce the labor, expense, and time needed to perform the operation while maintaining the previous safety devices put in place by the tubing system to thus reduce crew injuries and loss incidents and not interrupting other operations.

FIG. 1 illustrates an operation being performed on a sidetrack well 100 in accordance with one or more embodiments. A main well 105 (hereinafter also simply "well") is drilled within a formation 110. The main well 105 may include a horizontal interval. The sidetrack well 100 branching off the main well 105 is also drilled within the formation 110. Though the main well 105 may have any number of sidetrack wells 100 branching off it without departing from the scope of the disclosure. The formation 110 includes layers of rock 115 separated by geological discontinuities 120. One or more layers of rock 115 may specifically be a reservoir 125 that stores oil and gas (collectively denoted "production").

Prior to one or more completion and/or recovery operations, a tubing system 130 may be disposed and installed along a window or interval 135 of the main well 105 and over an opening 140 (i.e., kickout point) of the sidetrack well 100. The tubing system 130 includes an interval control valve (not shown) among other parts, such as packers (not shown) above and below the interval control valve. During some operations, the interval control valve may be configured to control an amount of production flowing from the reservoir 125 to the main well 105, which may include the sidetrack well 100, along the interval 135. Accordingly, the main well 105 may be a production well. During other operations, the interval control valve may be configured to control an amount of injection fluid being injected into the reservoir 125 through the main well 105 along the interval 135. Accordingly, the main well 105 may be an injection well.

Following installation of the tubing system 130 downhole within the main well 105, the sidetrack well 100 at or below the tubing system 130 may not be easily accessed. Accordingly, operations on the sidetrack well 100 may only be performed with great difficulty or not at all. This limitation is illustrated in FIG. 1. To perform the operation on the sidetrack well 100, a bottom hole assembly 145, such as a stimulation system (e.g., hydraulic fracturing system) or well logging system, may be fixed to a distal end of a conveyance mechanism 150. The bottom hole assembly 145 and conveyance mechanism 150 may be supported by a truck 155 and derrick 160 above ground. The truck 155 may carry the conveyance mechanism 150 used to lower the bottom hole assembly 145 into the well 105 and sidetrack well 100. The conveyance mechanism 150 may be a wireline, coiled tubing, wired-coiled tubing, drillpipe, wired drillpipe, slickline, monocable or any other conveyance mechanism that may include means to provide power to the bottom hole assembly 145 and/or a telemetry channel from the bottom hole assembly 145 to the surface of the Earth 165. The bottom hole assembly 145 may be translated along the sidetrack well 100 to perform the operation over an interval of the sidetrack well 100.

However, because the tubing system 130 or portion thereof does not have an opening adjacent to the opening 140 of the sidetrack well 100, the bottom hole assembly 145 cannot translate though the tubing system 130 and into the sidetrack well 100 though it is shown as such in FIG. 1.

FIGS. 2-6 illustrate the device or portion thereof in accordance with one or more embodiments. Use of the device as a part of the interval control valve within the tubing system 130 allows the bottom hole assembly 145 and conveyance mechanism 150 to translate through the tubing system 130, past packers and the interval control valve, and into the sidetrack well 100 as shown in FIG. 1. An operation may then be performed on the sidetrack well 100 using the bottom hole assembly 145 without deinstallation and retrieval of the tubing system 130 from the main well 105 and without disposal and retrieval of a separate deflector. Accordingly, incidents of a dropped and/or stuck tubing system 130 (or portions thereof) and/or deflectors are no longer a concern.

Figure 2:
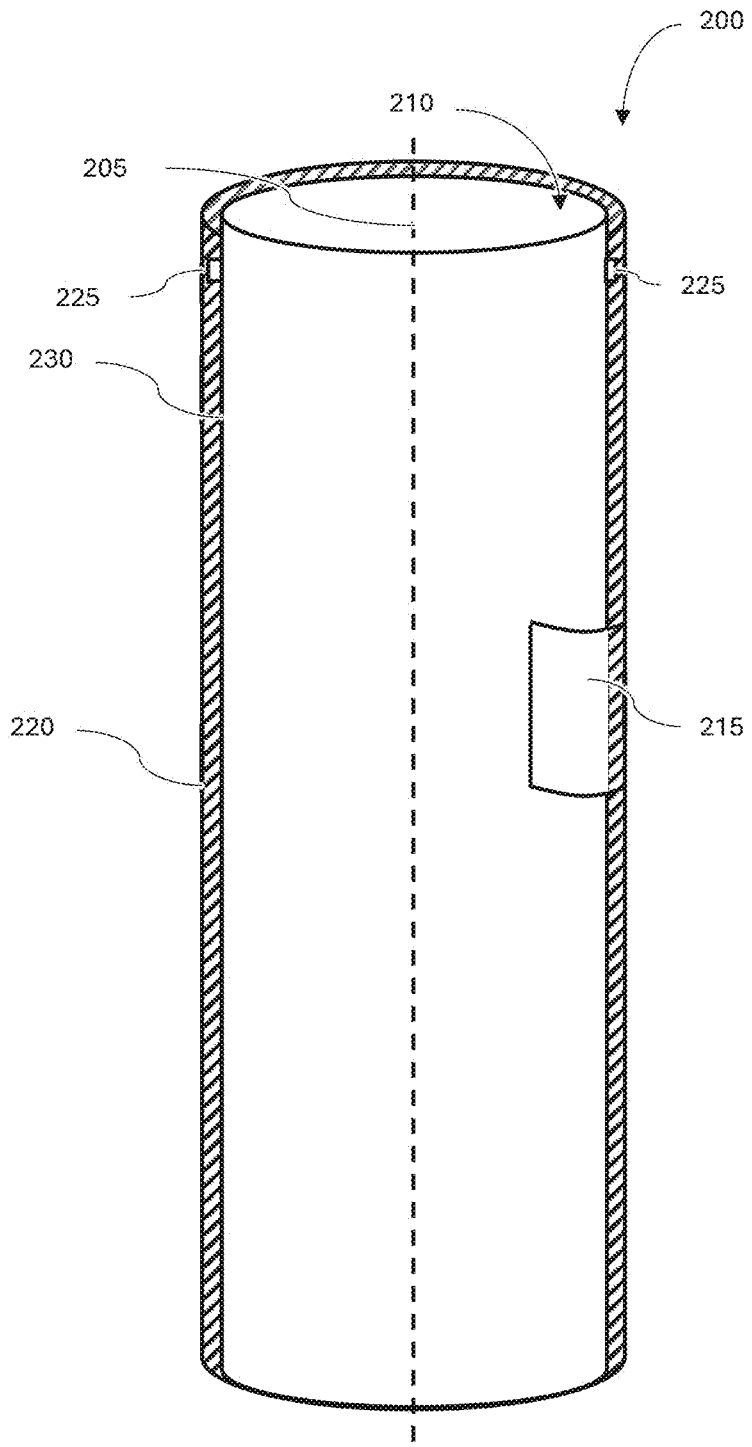
FIG. 2 illustrates an outer sleeve in accordance with one or more embodiments.

The device may include an outer sleeve, inner sleeve, deflector, and two control lines. FIG. 2 illustrates the outer sleeve 200 of the device. The outer sleeve 200 extends along an axis 205. The outer sleeve 200 may be cylindrical though the diameter of the cylinder need not stay the same along the axis 205. The outer sleeve 200 has an outer chamber 210 and outer opening 215 (i.e., outer port). The outer opening 215 extends from the outer chamber 210 to an outer surface 220 of the outer sleeve 200. The outer opening 215 may be anywhere along the length of the outer surface 220 along the axis 205 without departing from the scope of the disclosure.

The outer sleeve 200 may have slots 225 extending from an inner surface 230 of the outer chamber 210 radially outward away from the axis 205.

Figure 3:
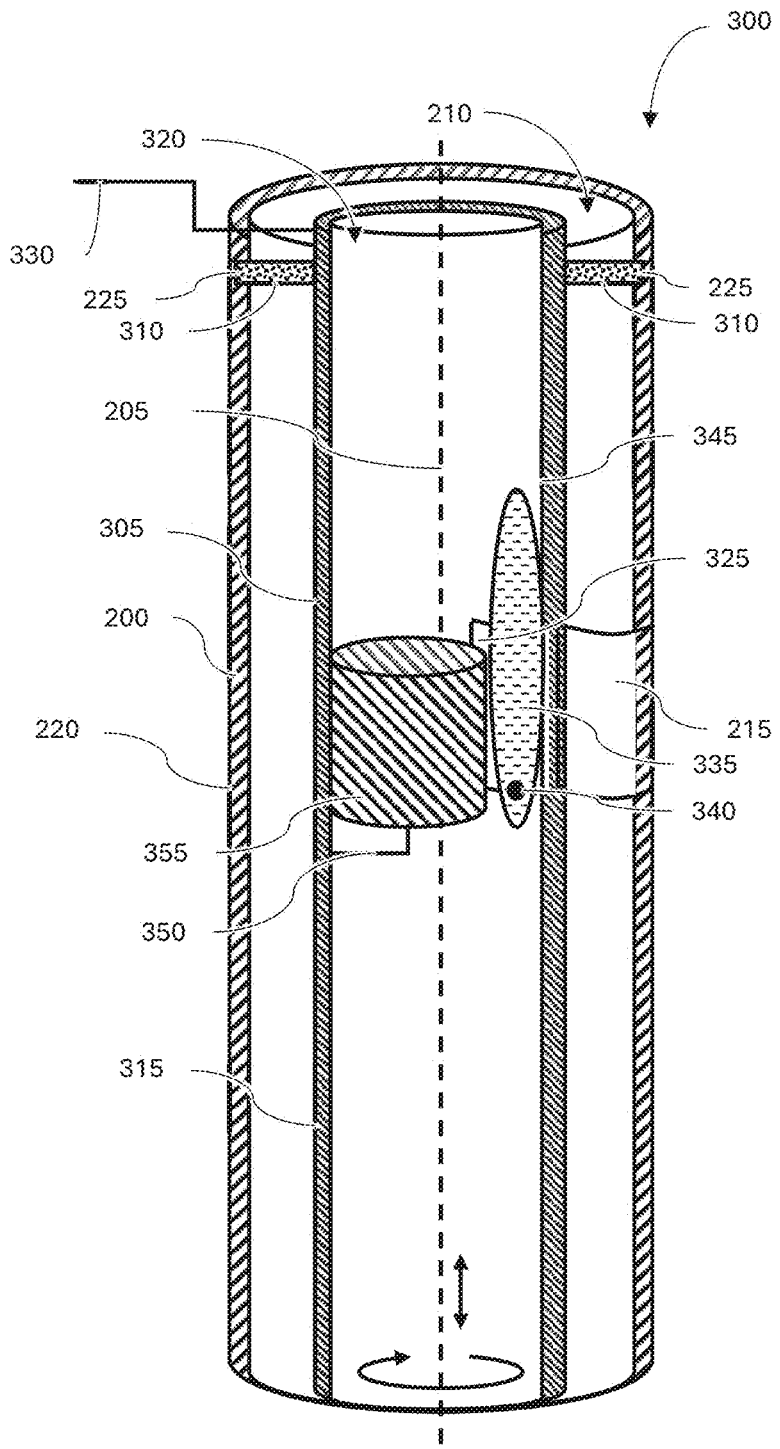
FIGS. 3-6 illustrate a device in accordance with one or more embodiments.

FIG. 3 illustrates the device 300 in accordance with one or more embodiments. The inner sleeve 305 is disposed within the outer chamber 210 of the outer sleeve 200. The inner sleeve 305 extends along the axis 205. The inner sleeve 305 may be cylindrical though the diameter of the cylinder need not stay the same along the axis 205. Pins 310 may extend radially outward from an outer surface 315 of the inner sleeve 305 or extend radially inward from an inner surface 230 of the outer chamber 210 of the outer sleeve 200. The end of each pin 310 may be disposed within a corresponding slot 225 of the outer sleeve 200 or corresponding slot (not shown) of the inner sleeve 305. Accordingly, the pins 310 may fix the inner sleeve 305 and outer sleeve 200 together while the device 300 is disposed downhole. To separate the inner sleeve 305 and outer sleeve 200 from one another, the pins 310 may be pushed or retracted radially inward or outward in response to an increase in pressure along a first control line as further described below.

The inner sleeve 305 has an inner chamber 320 and inner opening 325 (i.e., inner port). The inner opening 325 extends from the inner chamber 320 to the outer surface 315 of the inner sleeve 305. The inner opening 325 may be substantially at the same position along the axis 205 as the outer opening 215.

Accordingly, the inner opening 325 of the inner sleeve 305 and the outer opening 215 of the outer sleeve 200 may be aligned and misaligned relative to one another. To align the inner opening 325 and outer opening 215, the inner sleeve 305 may be rotated around the axis 205 by a first rotation and/or translated along the axis 205 by a first translation relative to the outer sleeve 200 or vice versa. Alignment of the inner opening 325 and outer opening 215 is referred to as the device 300 being in an open position. To misalign the inner opening 325 and outer opening 215, the inner sleeve 305 may be rotated around the axis 205 by a second rotation and/or translated along the axis 205 by a second translation relative to the outer sleeve 200 or vice versa. Misalignment of the inner opening 325 and outer opening 215 is referred to as the device 300 being in a closed position.

The open position and closed position of the device 300 (as well as the position of the pins 310) may be controlled by a first control line 330. The first control line 330 may be coupled to the inner sleeve 305 or outer sleeve 200. The first control line 330 may control the position of the device 300 by controlling the rotation and/or translation of the inner sleeve 305 relative to the outer sleeve 200 or vice versa. The first control line 330 may also control the position of the pins 310. For example, the first control line 330 may push or retract the pins 310 radially inward towards the axis 205 while the inner sleeve 305 is rotating and/or translating. To do so, the first control line 330 may be coupled to a hydraulic system 170. The hydraulic system 170 may be disposed on the surface of the Earth 165 and controlled by a control system 175, using commands, as illustrated in FIG. 1. In response to a first command, hydraulic fluid stored in the hydraulic system 170 may be released and conveyed downhole to thereby increase a pressure downhole to retract the pins 310 and rotate and/or translate the inner sleeve 305, for example, such that the device 300 is in the open position. In response to a second command, additional hydraulic fluid stored in the hydraulic system 170 may be released and conveyed downhole to thereby further increase the pressure downhole to further rotate and/or translate the inner sleeve 305, for example, such that the device is in the closed position.

Figure 4:
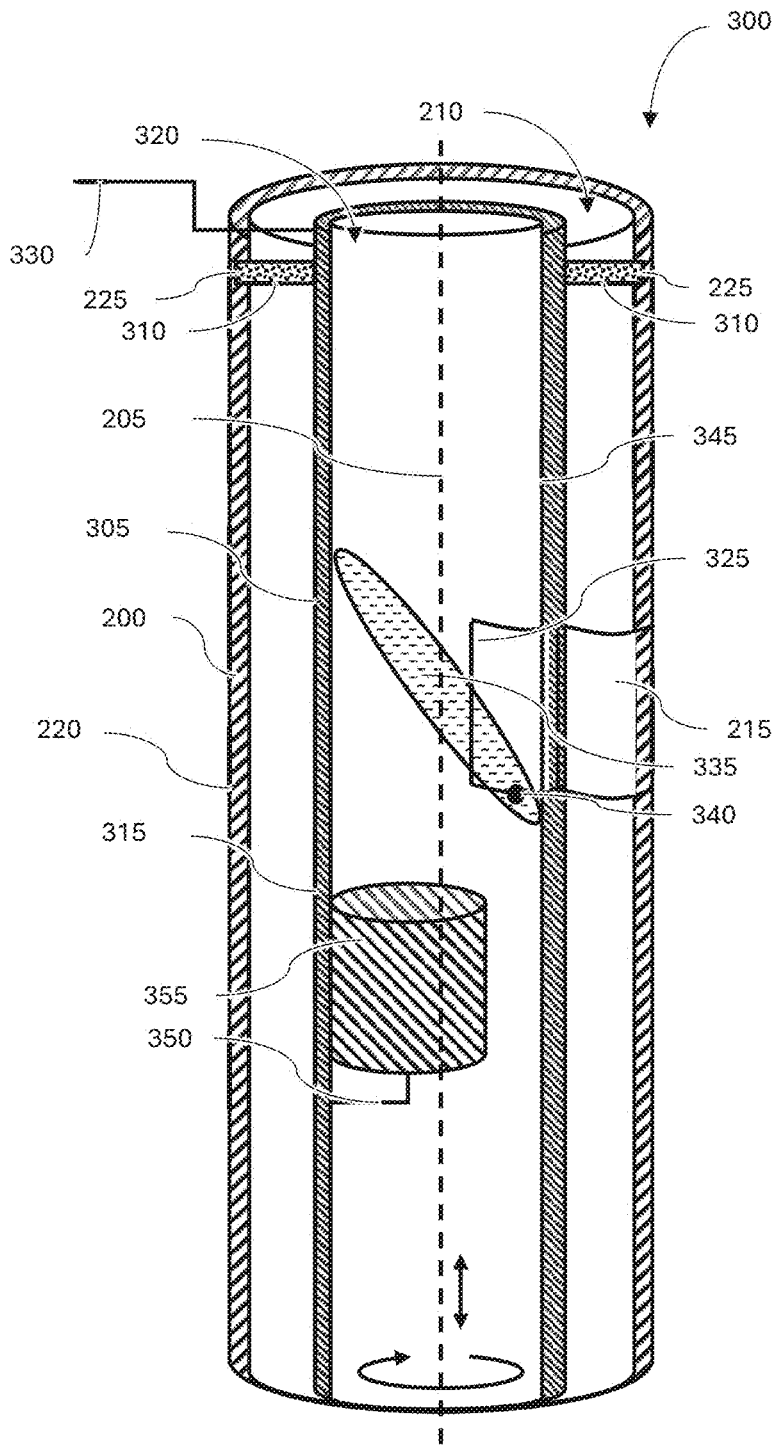

The deflector 335 of the device 300 is disposed within the inner chamber 320 of the inner sleeve 305 and adjacent to the inner opening 325. FIG. 3 illustrates the deflector 335 disposed directly adjacent to the inner opening 325. However, the deflector 335 could alternatively be disposed on an opposing inner surface 345 of the inner chamber 320 such that the deflector 335 is indirectly adjacent to the inner opening 325. The deflector 335 may include a hinge 340 such that the deflector 335 is rotatable around the hinge 340. FIG. 3 illustrates the hinge 340 disposed through an inferior end of the deflector 335. However, when the deflector 335 is indirectly adjacent to the inner opening 325, the hinge 340 may be disposed through a superior end of the deflector 335. The deflector 335 may be an ovoid in shape such that when the deflector 335 is in its closed position, the deflector 335 nests at an angle within the inner chamber 320 with little-to-no space between the deflector 335 and an inner surface 345 of inner chamber 320. FIG. 3 illustrates the deflector 335 in an open position. FIG. 4 illustrates the deflector 335 in the closed position.

The open and closed positions of the deflector 335 may be controlled by a second control line 350. The second control line 350 may be coupled to the deflector 335 via a hydraulic cylinder 355 and inferior spring (not shown). The second control line 350 may control the position of the deflector 335 by controlling the position of the hydraulic cylinder 355 and length of the spring. To do so, the second control line 350 may be coupled to the hydraulic system 170, though the hydraulic system 170 need not be the same hydraulic system 170 that the first control line 330 is coupled to. Translation of the hydraulic cylinder 355 upward or superiorly may open the deflector 335 as FIG. 3 illustrates. In some embodiments, a pressure of around 28 kilopascals (kPa) (or around 4000 pounds per square inch (psi)) within the second control line 350 may be sufficient to maintain the deflector 335 in the open position. Translation of the hydraulic cylinder 355 downward or inferiorly and compression of the spring may close the deflector 335 as FIG. 4 illustrates. In some embodiments, a pressure of around 14 kPa (or 2000 psi) may be sufficient to maintain the deflector 335 in the closed position. When the deflector 335 is in the closed position, the deflector 335 may act as a whipstock to guide the conveyance mechanism 150 and bottom hole assembly 145 through the inner opening 325 and outer opening 215 and into the sidetrack well 100. Accordingly, the deflector 335 may be at an angle around 45 degrees when in the closed position as illustrated in FIG. 4.

Figure 5:
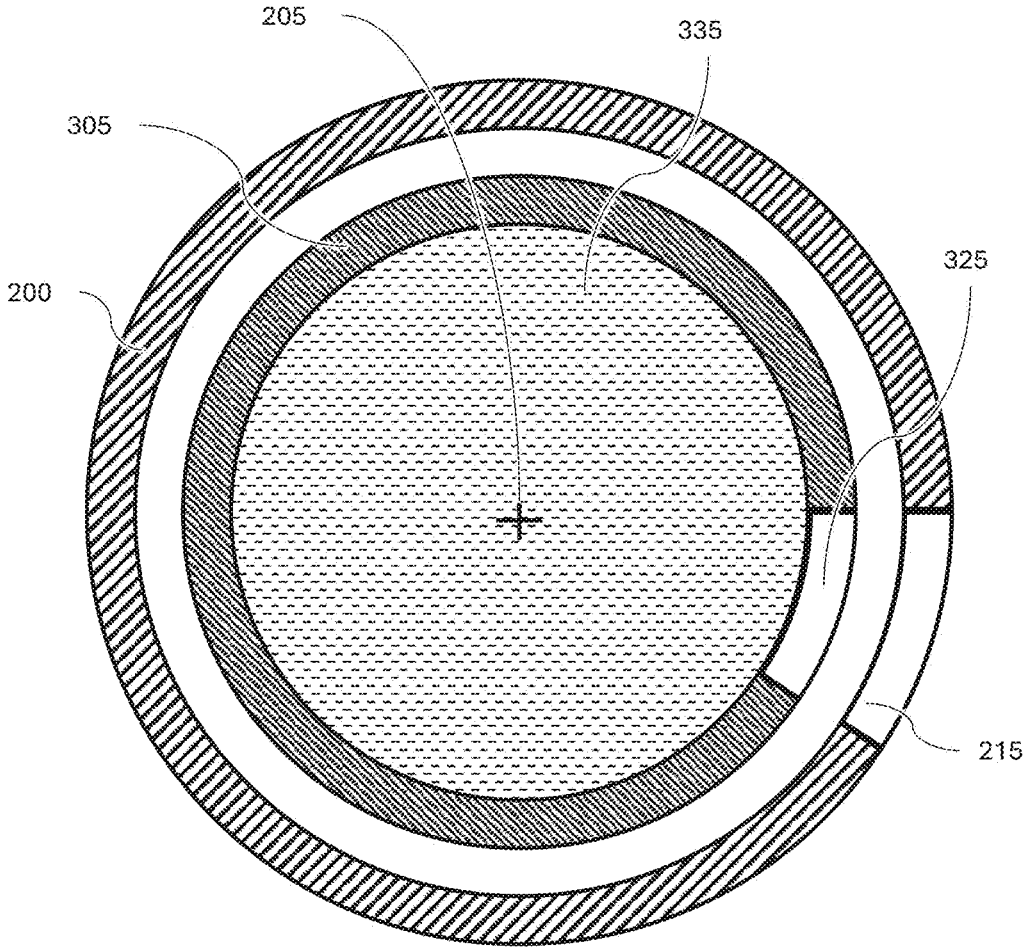
Figure 6:
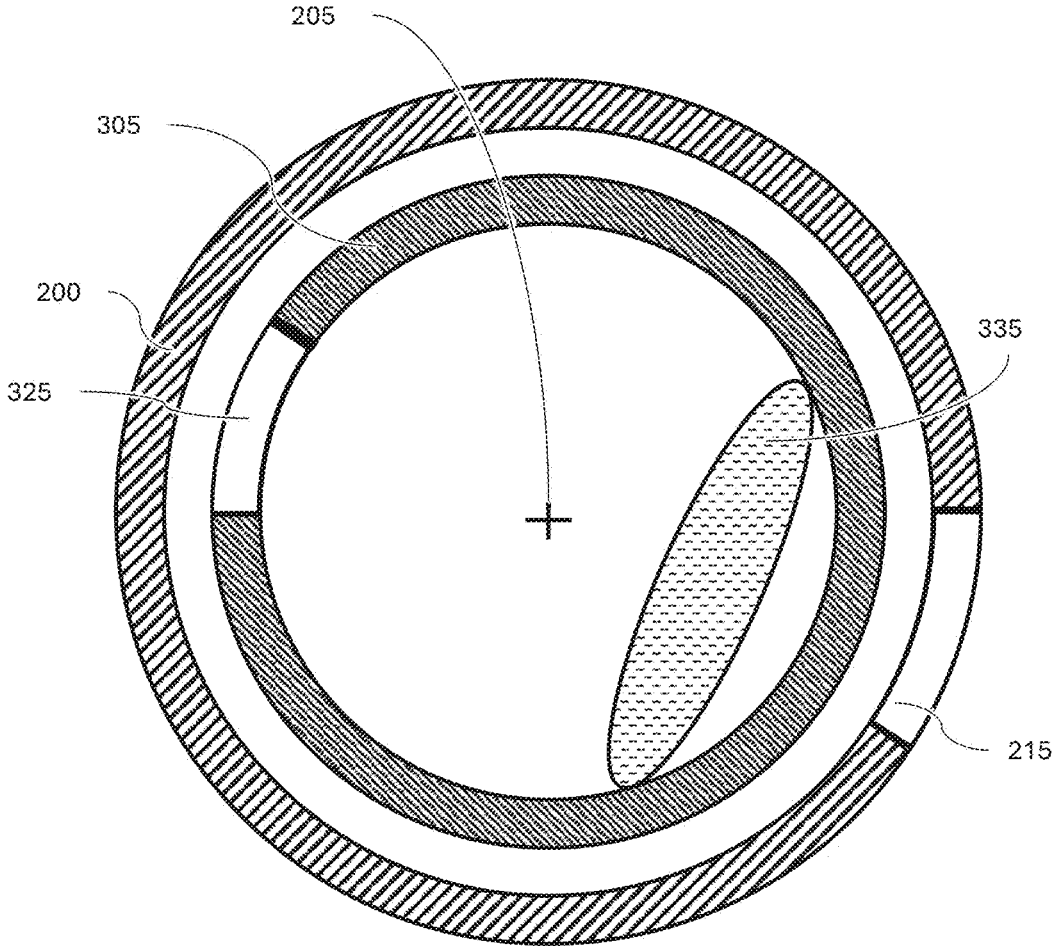

FIGS. 5 and 6 illustrate a top-down view of the device 300 in accordance with one or more embodiments. FIG. 5 illustrates the device 300 in the open position and the deflector 335 is the closed position. When the device 300 is in the open position, the inner opening 325 and outer opening 215 are aligned. When the deflector 335 is in the closed position, the deflector 335 nests within the inner chamber 320 of the inner sleeve 305. As such, the bottom hole assembly 145 and conveyance mechanism 150 are disposable through the inner chamber 320 of the inner sleeve 305, through the inner opening 325 and outer opening 215, guided by the deflector 335 acting as a whipstock, through the opening 140 of the sidetrack well 100, and into the sidetrack well 100. Following disposition of the bottom hole assembly 145 into the sidetrack well 100, an operation may be performed on the sidetrack well 100 using the bottom hole assembly 145.

FIG. 6 illustrates the device 300 in the closed position and the deflector 335 in the open position. When the device 300 is in the closed position, the inner opening 325 and outer opening 215 are misaligned. When the deflector 335 is in the open position, the deflector 335 rests substantially upright. As illustrated in FIG. 6, the first rotation and second rotation of, for example, the inner sleeve 305 may be separated by 180 degrees. However, any degree of rotation that causes no overlap between the inner opening 325 and outer opening 215 may be sufficient for the device 300 to be in the closed position.

When the device 300 and deflector 335 are both in the open position, the interval control valve is free to operate as configured or designed to either control the amount of production flowing from the reservoir 125 into the well 105 or control the amount of injection fluid being injected into the reservoir 125 through the well 105.

When the device 300 is in the closed position and the deflector 335 is in the open position as illustrated in FIG. 6, the tubing system 130 with the interval control valve is "shut-in" and does not operate as configured or designed. Furthermore, the sidetrack well 100 cannot be accessed when the device 300 is in the closed position. However, tubing systems 130 disposed and installed further downhole are free to operate as configured or designed.

Figure 7:
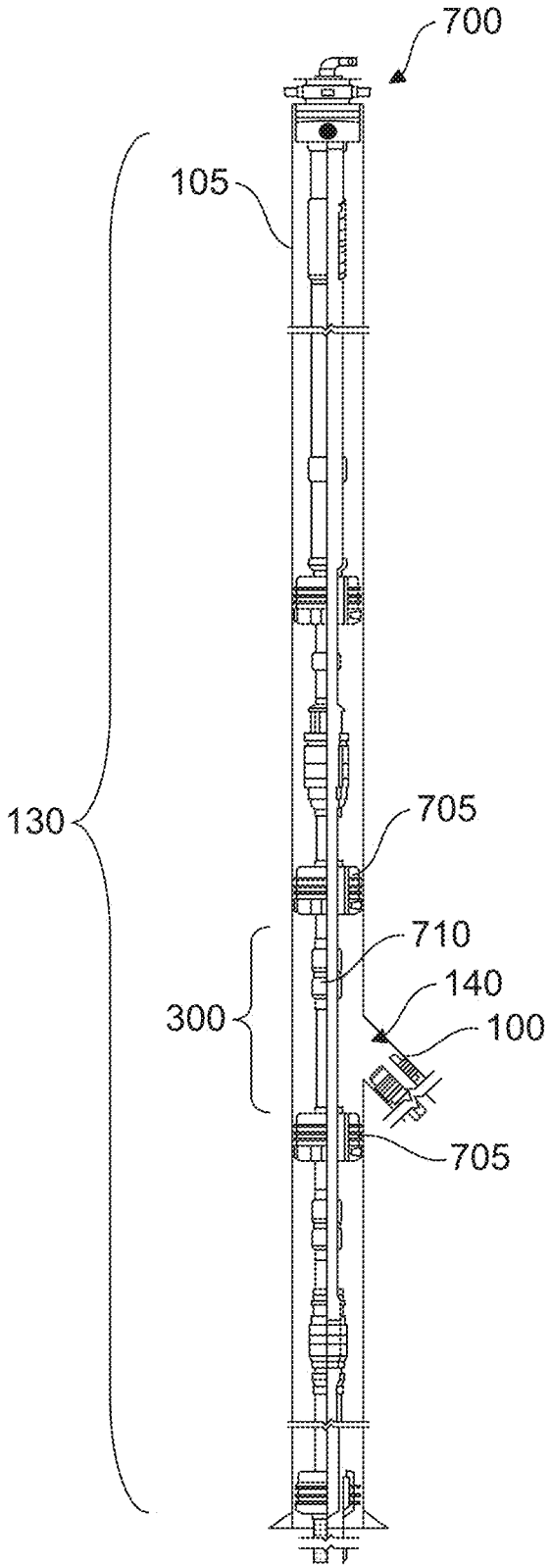
FIG. 7 illustrates a system in accordance with one or more embodiments.

FIG. 7 illustrates the system 700 disposed downhole within the well 105 in accordance with one or more embodiments. The system 700 includes the tubing system 130 that includes the device 300, a packer 705 disposed at each end of the device 300, and the interval control valve 710 disposed within the device 300, among other parts. The device 300 is disposed within an interval 135 along the main well 105 that includes the opening 140 to the sidetrack well 100.

Figure 8:
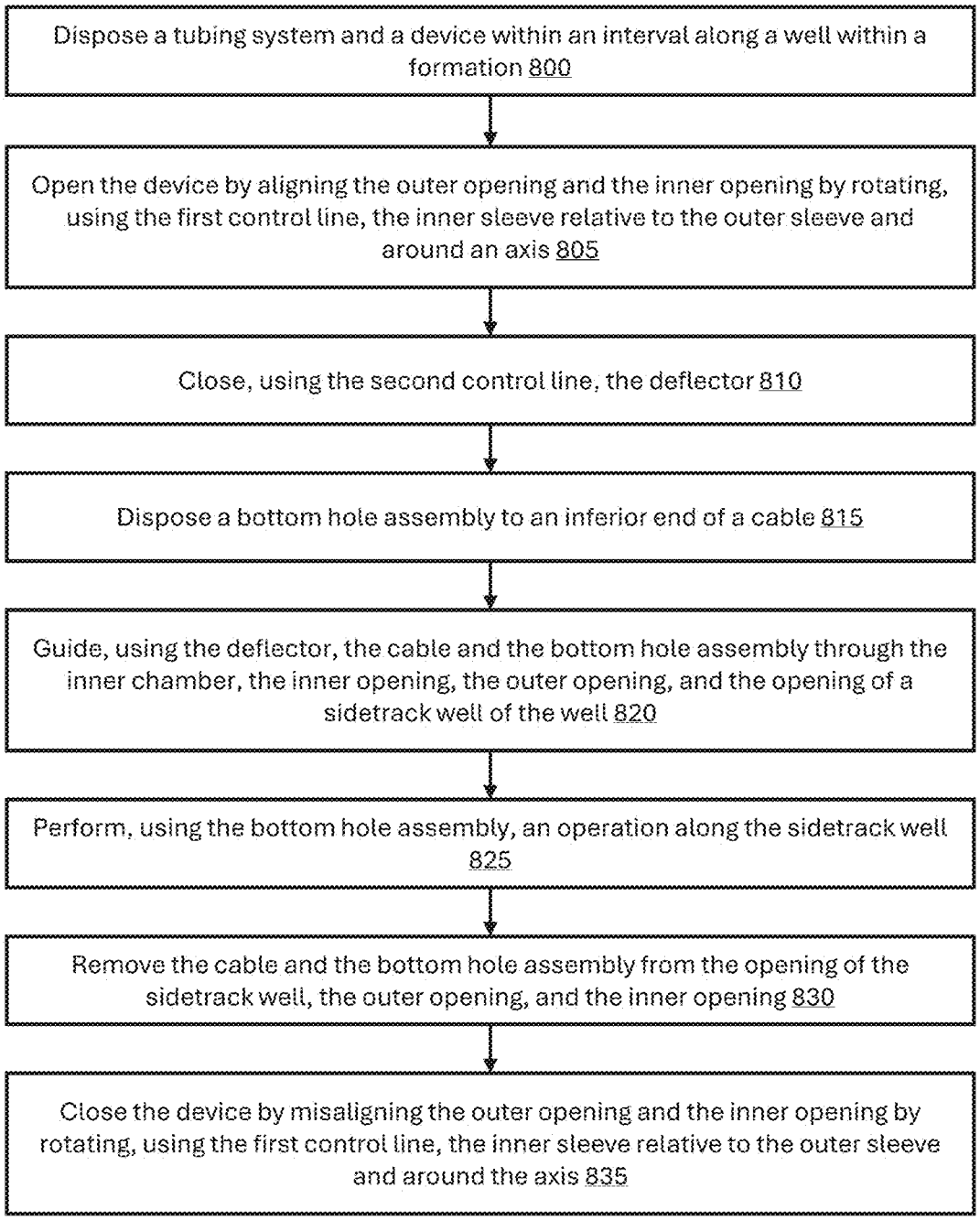
FIG. 8 details a method in accordance with one or more embodiments.

FIG. 8 shows a flowchart of a method in accordance with one or more embodiments. Though FIG. 8 describes the method as sequential steps, the method may be performed where any number of steps are performed in parallel or in a different order without departing from the scope of the disclosure.

In step 800, a tubing system 130 and device 300 are disposed and installed downhole within an interval 135 along a well 105 drilled within a formation 110 and at an opening 140 of a sidetrack well 100 branching off the well 105. The device 300 is disposed downhole such that the outer opening 215 of the outer sleeve 200, inner opening 325 of the inner sleeve 305, and opening 140 of the sidetrack well 100 may be aligned or misaligned with one another.

In step 805, the device 300 is opened by aligning the outer opening 215 of the outer sleeve 200, inner opening 325 of the inner sleeve 305, and opening 140 of the sidetrack well 100 with one another. To open the device 300, hydraulic fluid from the hydraulic system 170 may be used to rotate the inner sleeve 305 relative to the outer sleeve 200 and around the axis 205 or vice versa until the inner opening 325 and outer opening 215 are aligned as illustrated in FIG. 5. In some embodiments, the hydraulic fluid may, also or alternatively, translate the inner sleeve 305 relative to the outer sleeve 200 and along the axis 205 or vice versa until the inner opening 325 and outer opening 215 are aligned as illustrated in FIG. 5.

In step 810, the deflector 335 is closed. To close the deflector 335, hydraulic fluid from the hydraulic system 170 may be used to translate the hydraulic cylinder 355 inferiorly such that the deflector 335 may rotate around its hinge 340 towards an opposing inner surface 345 of the inner sleeve 305 as illustrated in FIGS. 4 and 6.

In steps 815 and 820, a bottom hole assembly 145 via the conveyance mechanism 150 is disposed downhole within the well 105. The bottom hole assembly 145 and conveyance mechanism 150 translate through the well 105, through the inner chamber 320 of the inner sleeve 305, are deflected or guided by the deflector 335 through the inner opening 325, outer opening 215, and opening 140 of the sidetrack well 100.

In step 825, the bottom hole assembly 145 performs an operation along an interval of the sidetrack well 100. The operation may be a completion or recovery operation. However, the choice of the operation need not limit the disclosure.

In step 830, the bottom hole assembly 145 is removed or retrieved from the sidetrack well 100 and well 105 uphole via the conveyance mechanism 150. Accordingly, the bottom hole assembly 145 and conveyance mechanism 150 are translated superiorly through the opening 140 of the sidetrack well 100, the outer opening 215, the inner opening 325, and past the deflector 335 through the inner chamber 320.

In step 835, the device 300 is closed by misaligning the outer opening 215 and the inner opening 325 as shown in FIG. 6. To close the device 300, the inner sleeve 305 is rotated around the axis 205 and/or translated along the axis 205 relative to the outer sleeve 200 or vice versa. The inner sleeve 305 or outer sleeve 200 may be rotated and/or translated using the first control line 330 and hydraulic fluid of the hydraulic system 170. The deflector 335 can also be opened using the second control line 350. Accordingly, the opening and closing of the deflector 335 would not interrupt functions associated with other sidetrack wells 100 further downhole.

Advantageously, steps 805 and 835 may be repeated any number of times without departing from the scope of the disclosure. Accordingly, the device 300 may be repeatedly opened and/or closed while disposed within the interval 135 along the main well 105.

Figure 9:
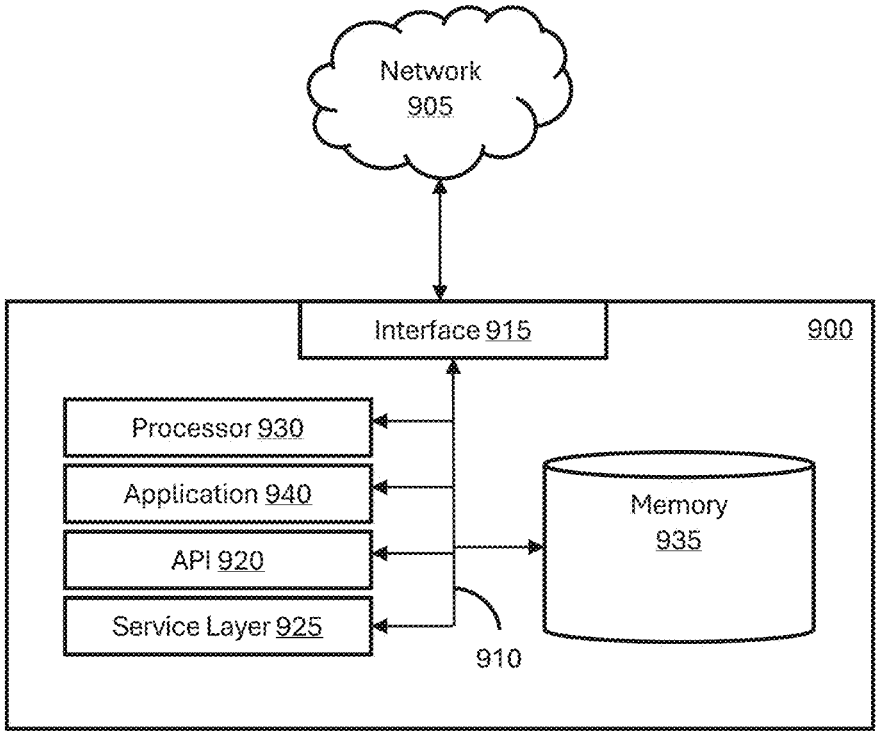
FIG. 9 illustrates a computer system in accordance with one or more embodiments.

FIG. 9 illustrates a computer system 900 in accordance with one or more embodiments. The control system 175 may be or include the computer system 900. The computer system 900 is intended to depict any computing device such as a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer system 900 may include an input device, such as a keypad, keyboard, touch screen, or other device that can accept user information, and an output device that displays information, including digital data, visual or audio information (or a combination of both), or a graphical user interface (GUI).

The computer system 900 can serve in a role as a client, network component, server, database, or any other component (or a combination of roles) of a computer system 900 as required to perform the disclosed methods. The illustrated computer system 900 is communicably coupled with a network 905. In some implementations, one or more components of each computer system 900 may be configured to operate within environments, including cloud-computing-based, local, global, or other environment (or a combination of environments).

At a high level, the computer system 900 is an electronic computing device operable to receive, transmit, process, store, and/or manage data and information associated with the disclosed methods. According to some implementations, the computer system 900 may also include or be communicably coupled with an application server, e-mail server, web server, caching server, streaming data server, business intelligence (BI) server, or other server (or a combination of servers).

The computer system 900 can receive requests over the network 905 from other computer systems 900 or another client application and respond to the received requests by processing the requests appropriately. In addition, requests may also be sent to the computer system 900 from internal users (for example, from a command console or by other appropriate access method), external or third-parties, other automated applications, as well as any other appropriate entities, individuals, systems, or computer systems 900.

Each of the components of the computer system 900 can communicate using a system bus 910. In some implementations, any or all of the components of each computer system 900, both hardware or software (or a combination of hardware and software), may interface with each other or the interface 915 (or a combination of both) over the system bus 910 using an application programming interface (API) 920 or a service layer 925 (or a combination of the API 920 and service layer 925. The API 920 may include specifications for routines, data structures, and object classes. The API 920 may be either computer-language independent or dependent and refer to a complete interface, a single function, or even a set of APIs. The service layer 925 provides software services to each computer system 900 or other components (whether or not illustrated) that are communicably coupled to each computer system 900. The functionality of each computer system 900 may be accessible for all service consumers using this service layer 925. Software services, such as those provided by the service layer 925, provide reusable, defined business functionalities through a defined interface. For example, the interface may be software written in JAVA, C++, or other suitable language providing data in extensible markup language (XML) format or another suitable format. While illustrated as an integrated component of each computer system 900, alternative implementations may illustrate the API 920 or the service layer 925 as stand-alone components in relation to other components of each computer system 900 or other components (whether or not illustrated) that are communicably coupled to each computer system 900. Moreover, any or all parts of the API 920 or the service layer 925 may be implemented as child or sub-modules of another software module, enterprise application, or hardware module without departing from the scope of this disclosure.

The computer system 900 includes the interface 915. Although illustrated as a single interface 915 in FIG. 9, two or more interfaces 915 may be used according to particular needs, desires, or particular implementations of each computer system 900. The interface 915 is used by each computer system 900 for communicating with other systems in a distributed environment that are connected to the network 905. Generally, the interface 915 includes logic encoded in software or hardware (or a combination of software and hardware) and operable to communicate with the network 905. More specifically, the interface 915 may include software supporting one or more communication protocols associated with communications such that the network 905 or interface's hardware is operable to communicate physical signals within and outside of the illustrated computer system 900.

The computer system 900 includes at least one computer processor 930. Generally, a computer processor 930 executes any instructions, algorithms, methods, functions, processes, flows, and procedures as described above. A computer processor 930 may be a central processing unit (CPU) and/or a graphics processing unit (GPU).

The computer system 900 also includes a memory 935, i.e., a non-transitory computer readable medium, that stores data and software, i.e., computer-executable instructions, for the computer system 900 or other components (or a combination of both) that can be connected to the network 905. Although illustrated as a single memory 935 in FIG. 9, two or more memories 935 may be used according to particular needs, desires, or particular implementations of the computer system 900 and the described functionality.

While memory 935 is illustrated as an integral component of each computer system 900, in alternative implementations, memory 935 can be external to each computer system 900.

The application 940 is an algorithmic software engine providing functionality according to particular needs, desires, or particular implementations of the computer system 900, particularly with respect to functionality described in this disclosure. For example, application 940 can serve as one or more components, modules, applications, etc. Further, although illustrated as a single application 940, the application 940 may be implemented as multiple applications 940 on each computer system 900. In addition, although illustrated as integral to each computer system 900, in alternative implementations, the application 940 can be external to each computer system 900.

There may be any number of computer systems 900, such as computer clusters, where each computer system 900 communicates over the network 905. Further, the term "client," "user," and other appropriate terminology may be used interchangeably as appropriate without departing from the scope of this disclosure. Moreover, this disclosure contemplates that many users may use the computer system 900, or that one user may use multiple computer systems 900.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed is:

1. A device comprising:

an outer sleeve extending along an axis and having:

an outer chamber, and an outer opening extending from the outer chamber to an outer surface of the outer sleeve;

an inner sleeve disposed within the outer chamber and having:

an inner chamber, and an inner opening extending from the inner chamber to an outer surface of the inner sleeve, wherein the inner opening is alignable with the outer opening by a first rotation of the inner sleeve relative to the outer sleeve and around the axis, and wherein the inner opening is misalignable with the outer opening by a second rotation of the inner sleeve relative to the outer sleeve and around the axis;

a deflector disposed within the inner chamber and adjacent to the inner opening;

a first hydraulic control line coupled to the inner sleeve and that controls:

an open position of the device by controlling the first rotation, and a closed position of the device by controlling the second rotation; and a second control line coupled to the deflector and that controls an open position and a closed position of the deflector.

2. The device of claim 1, wherein the outer sleeve has a plurality of slots, wherein the device further comprises each of a plurality of pins extending radially outward from the outer surface of the inner sleeve and disposed with a corresponding slot among the plurality of slots, and wherein the plurality of pins is radially translatable towards the axis.

3. The device of claim 1, wherein the first rotation and the second rotation are separated by 180 degrees.

4. The device of claim 1, wherein the inner sleeve is translatable relative to the outer sleeve and along the axis, wherein the first hydraulic control line controls:

the open position of the device by controlling a first translation; and the closed position of the device by controlling a second translation.

5. The device of claim 1, wherein the second control line comprises a second hydraulic control line.

6. The device of claim 1, wherein the deflector is an ovoid.

7. The device of claim 1, wherein the deflector is rotatable around a hinge and towards an opposing inner surface of the inner sleeve.

8. The device of claim 1, further comprising an interval control valve disposed within the inner chamber and that controls an amount of fluid.

9. A system comprising:

a tubing system disposed within an interval along a well within a formation and configured to control an amount of fluid; and a device disposed along the tubing system and comprising:

an outer sleeve extending along an axis and having:

an outer chamber; and an outer opening extending from the outer chamber to an outer surface of the outer sleeve, an inner sleeve disposed within the outer chamber and having:

an inner chamber; and an inner opening extending from the inner chamber to an outer surface of the inner sleeve, wherein the inner opening aligns with the outer opening by a first rotation of the inner sleeve relative to the outer sleeve and around the axis, and wherein the inner opening misaligns with the outer opening by a second rotation of the inner sleeve relative to the outer sleeve and around the axis, a deflector disposed within the inner chamber and adjacent to the inner opening, a first hydraulic control line coupled to the inner sleeve and configured to control:

an open position of the device by controlling the first rotation; and a closed position of the device by controlling the second rotation, and a second control line coupled to the deflector and configured to control an open position and a closed position of the deflector.

10. The system of claim 9, further comprising a hydraulic system coupled to the first hydraulic control line and the second control line, wherein the hydraulic system is configured to convey a hydraulic fluid through the first hydraulic control line and the second control line.

11. The system of claim 10, further comprising a control system coupled to the hydraulic system, wherein the control system is configured to control, using a command, an amount of the hydraulic fluid conveyed through each of the first hydraulic control line and the second control line.

12. The system of claim 9, further comprising a conveyance mechanism configured to dispose through the inner chamber, the inner opening, the outer opening, and an opening of a sidetrack well branching off the well.

13. A method comprising:

disposing a tubing system and a device within an interval along a well within a formation, the device comprising:

an outer sleeve extending along an axis and having:

an outer chamber; and an outer opening extending from the outer chamber to an outer surface of the outer sleeve, an inner sleeve disposed within the outer chamber and having:

an inner chamber; and an inner opening extending from the inner chamber to an outer surface of the inner sleeve, a deflector disposed within the inner chamber and adjacent to the inner opening, a first hydraulic control line coupled to the inner sleeve, and a second control line coupled to the deflector, wherein the interval comprises an opening of a sidetrack well branching off the well;

opening the device by aligning the outer opening and the inner opening by rotating, using the first hydraulic control line, the inner sleeve relative to the outer sleeve and around the axis by a first rotation;

closing, using the second control line, the deflector; and guiding, using the deflector, a conveyance mechanism through the inner chamber, the inner opening, the outer opening, and the opening of the sidetrack well.

14. The method of claim 13, further comprising:

disposing a bottom hole assembly to an inferior end of the conveyance mechanism;

guiding, using the deflector, the bottom hole assembly through the inner chamber, the inner opening, the outer opening, and the opening of the sidetrack well, and performing, using the bottom hole assembly, an operation along the sidetrack well.

15. The method of claim 13, further comprising:

removing the conveyance mechanism from the opening of the sidetrack well, the outer opening, and the inner opening; and closing the device by misaligning the outer opening and the inner opening by rotating, using the first hydraulic control line, the inner sleeve relative to the outer sleeve and around the axis by a second rotation.

* * * * *